US010428636B2

(12) United States Patent
Rogers et al.

(10) Patent No.: US 10,428,636 B2
(45) Date of Patent: Oct. 1, 2019

(54) SOLIDS CONTROL METHODS, APPARATUS AND SYSTEMS

(71) Applicant: Halliburton Energy Services, Inc., Houston, TX (US)

(72) Inventors: Henry Eugene Rogers, Oklahoma City, OK (US); Michael Malave, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 262 days.

(21) Appl. No.: 15/516,553

(22) PCT Filed: Nov. 5, 2014

(86) PCT No.: PCT/US2014/064118
§ 371 (c)(1),
(2) Date: Apr. 3, 2017

(87) PCT Pub. No.: WO2016/072982
PCT Pub. Date: May 12, 2016

(65) Prior Publication Data

US 2018/0266231 A1 Sep. 20, 2018

(51) Int. Cl.
*E21B 43/38* (2006.01)
*E21B 27/00* (2006.01)
(Continued)

(52) U.S. Cl.
CPC ..... *E21B 43/38* (2013.01); *E21B 17/14* (2013.01); *E21B 21/002* (2013.01);
(Continued)

(58) Field of Classification Search
CPC ..... E21B 43/38; E21B 17/14; E21B 33/14; B01D 21/003; B01D 21/0033;
(Continued)

(56) References Cited

U.S. PATENT DOCUMENTS 1,312,027 A * 8/1919 Falley ..... B01D 21/0039 210/522
1,460,632 A * 7/1923 Wigle ..... E21B 3/025 166/241.6
(Continued)

FOREIGN PATENT DOCUMENTS

WO 2004094784 A2 11/2004
WO WO-2016068885 A1 * 5/2016 ..... E21B 43/08

OTHER PUBLICATIONS

Schlumberger Oilfield Glossary entry for "shoe track", accessed Mar. 14, 2019 via www.glossary.oilfield.slb.com.*
(Continued)

*Primary Examiner* — Blake E Michener
(74) *Attorney, Agent, or Firm* — Chamberlain Hrdlicka

(57) ABSTRACT

A weir assembly system comprises an insert dimensioned to be inserted into a section of a wellbore and a plurality of weirs spaced within the insert so as to increase the separation of solids from fluid within the section of the wellbore when the fluid is flowing through the wellbore. The plurality of weirs may be oriented to create a tortuous fluid flow path, such that a flow opening of a first weir causes solids to deposit at a second weir without obstructing a flow opening of the second weir. Additional apparatus, methods, and systems are disclosed.

16 Claims, 7 Drawing Sheets

(51) Int. Cl.

| | |
|---|---|
| ***E21B 17/14*** | (2006.01) |
| ***E21B 43/10*** | (2006.01) |
| ***E21B 21/00*** | (2006.01) |
| ***E21B 33/14*** | (2006.01) |
| ***E21B 43/04*** | (2006.01) |
| ***E21B 43/11*** | (2006.01) |

(52) U.S. Cl.
CPC ..... *E21B 27/005* (2013.01); *E21B 43/10* (2013.01); *E21B 33/14* (2013.01); *E21B 43/04* (2013.01); *E21B 43/11* (2013.01)

(58) Field of Classification Search
CPC ..... B01D 21/0042; F01N 1/083; F01N 13/1838; F01N 13/1844
USPC ..... 210/521, 522, 801
See application file for complete search history.

(56) References Cited

U.S. PATENT DOCUMENTS

| | | | | | |
|---|---|---|---|---|---|
| 2,178,846 | A * | 11/1939 | Baker | E21B 17/14 | 166/222 |
| 2,202,272 | A * | 5/1940 | Smith | F01N 1/083 | 181/270 |
| 2,271,002 | A | 1/1942 | Fosnaugh | | |
| 2,556,849 | A * | 6/1951 | Nolley | E21B 31/06 | 166/66.5 |
| 3,023,810 | A | 3/1962 | Anderson | | |
| 3,106,526 | A * | 10/1963 | Schmidt | E21B 43/38 | 166/105.1 |
| 3,425,913 | A * | 2/1969 | Holden | B01D 17/0211 | 165/109.1 |
| 3,559,760 | A * | 2/1971 | Ninomiya | F01N 1/083 | 181/231 |
| 3,703,467 | A * | 11/1972 | Lummus et al. | B01D 21/02 | 210/522 |
| 3,747,347 | A * | 7/1973 | Ciraolo | F01N 1/083 | 60/309 |
| 4,083,406 | A * | 4/1978 | Metz | C09K 8/50 | 166/162 |
| 4,167,987 | A * | 9/1979 | Turner | F01N 1/083 | 181/235 |
| 4,179,273 | A * | 12/1979 | Montusi | B01D 45/16 | 210/512.1 |
| 4,895,652 | A * | 1/1990 | Cornelissen | B01D 21/26 | 210/320 |
| 5,295,537 | A | 3/1994 | Trainer | | |
| 5,314,018 | A | 5/1994 | Cobb | | |
| 6,143,254 | A * | 11/2000 | Erven | B01D 53/565 | 422/168 |
| 6,214,092 | B1 * | 4/2001 | Odom | B01D 19/0042 | 210/188 |
| 6,755,250 | B2 * | 6/2004 | Hall | E21B 43/38 | 166/105.5 |
| 6,845,821 | B2 * | 1/2005 | Bouma | E21B 41/0035 | 166/105.5 |
| 7,753,113 | B1 | 7/2010 | Penisson | | |
| 8,584,744 | B2 * | 11/2013 | Soni | E21B 27/04 | 166/99 |
| 8,801,842 | B2 * | 8/2014 | Vandenbulcke | B01D 17/0211 | 96/207 |
| 8,844,619 | B2 * | 9/2014 | Soni | E21B 27/04 | 166/99 |
| 2005/0077235 | A1 * | 4/2005 | Rhodes | B01D 17/00 | 210/521 |
| 2006/0000993 | A1 * | 1/2006 | Kirk | E21B 17/22 | 251/126 |
| 2008/0209898 | A1 * | 9/2008 | Succi | B01D 45/08 | 60/311 |
| 2009/0008088 | A1 | 1/2009 | Schultz | | |
| 2009/0065431 | A1 * | 3/2009 | Bakke | B01D 17/0217 | 210/512.1 |
| 2010/0139919 | A1 | 6/2010 | Yeh et al. | | |
| 2011/0024112 | A1 | 2/2011 | Ford | | |
| 2011/0024119 | A1 | 2/2011 | Wolf et al. | | |
| 2013/0140032 | A1 | 6/2013 | Ford | | |
| 2013/0228075 | A1 | 9/2013 | Zylla | | |
| 2016/0177637 | A1 * | 6/2016 | Fleckenstein | E21B 17/22 | 166/285 |
| 2017/0211362 | A1 * | 7/2017 | Rogers | E21B 43/08 | |
| 2018/0135388 | A1 * | 5/2018 | Mericas | E21B 43/02 | |
| 2018/0202334 | A1 * | 7/2018 | Kimball | F01N 1/083 | |

OTHER PUBLICATIONS

International Search Report and Written Opinion dated Jul. 15, 2015 for PCT Application No. PCT/US2014/064118, filed on Nov. 5, 2014, 14 pages.

* cited by examiner

SOLIDS CONTROL METHODS, APPARATUS AND SYSTEMS

BACKGROUND

During well completion operations, casing is run into a wellbore, and wellbore fluids may enter the inner diameter of the casing through the activity of auto-fill equipment. These wellbore fluids carry solids or debris with them into the casing. The wellbore fluid may not be of sufficient viscosity to transport the solids, and when this occurs, the solids can settle within the casing. For example, in the case of a horizontal portion of a wellbore, the solids may accumulate at the lower side of the casing when they settle out of the wellbore fluid. The accumulated solids can be difficult, if not impossible, to remove with conventional filter systems that cannot be cleaned or unplugged. As such, in conventional systems, the shoe track capacity to contain contaminate slurry during cementing operations is limited. Further, conventional systems are susceptible to bridging, plugging, or pack-off during well completion operations.

BRIEF DESCRIPTION OF THE DRAWINGS

The present disclosure may be better understood, and its numerous features and advantages made apparent to those of ordinary skill in the art by referencing the accompanying drawings. The use of the same reference symbols in different drawings indicates similar or identical items.

DETAILED DESCRIPTION

FIGS. 1-8 illustrate example methods, apparatus, and systems for solids control during well construction operations, using a weir assembly to create tortuous fluid flow within a section of wellbore casing. Weirs can be oriented so as to increase the separation of solids from fluid within a section of the casing when the fluid is flowing through the casing. The weirs can be arranged in an insert to create the weir assembly, which is then inserted into the casing of the wellbore. As the fluid flows through the weir assembly, the shape, orientation, and placement of the weirs utilize gravity and velocity to enhance separation of the solids from the fluids in such a way that the solids may be removed by performing fluid circulation operations, thereby making the weir assembly self-cleaning.

Figure 1:
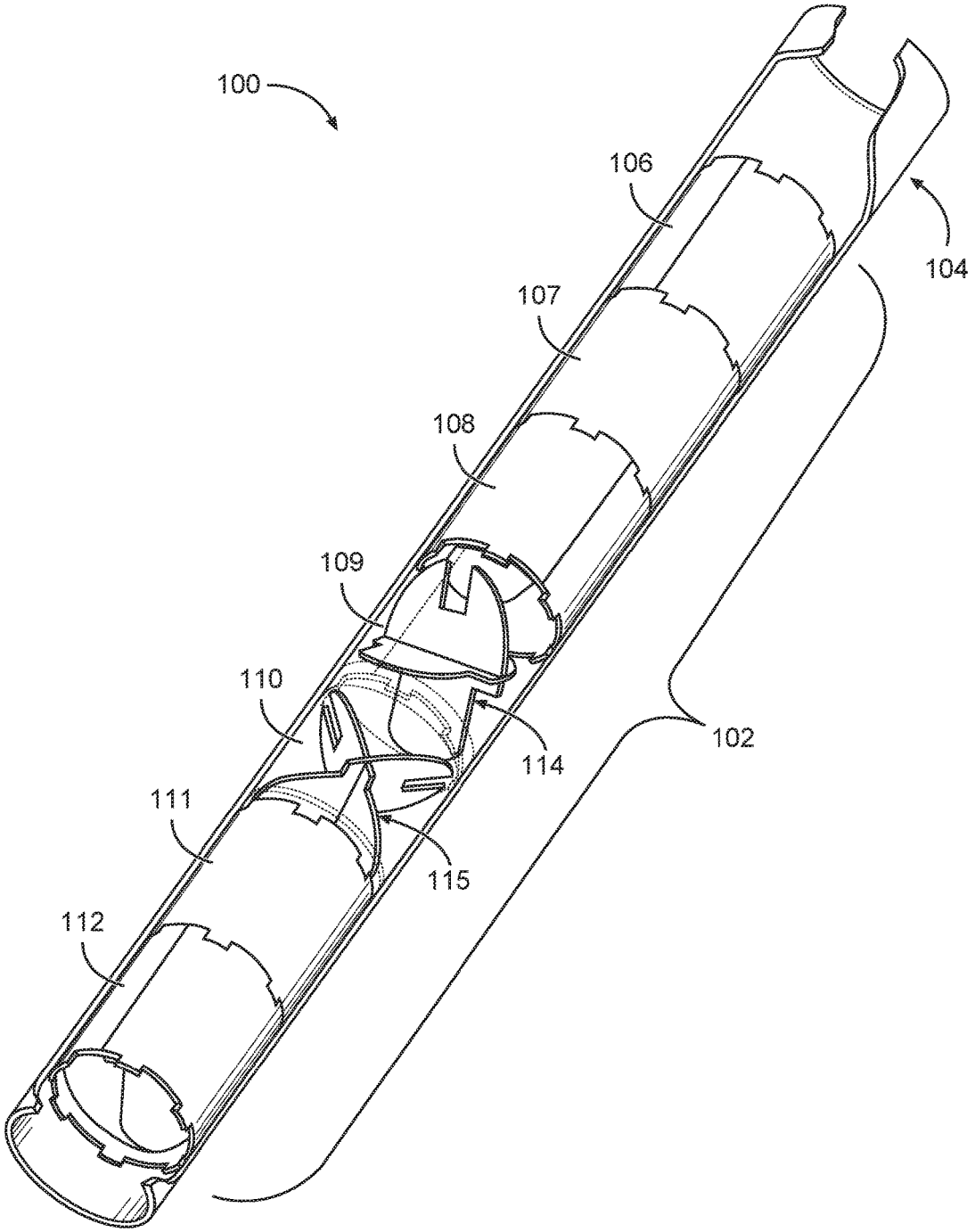
FIG. 1 depicts an example solids control system, in accordance with some embodiments.

FIG. 1 depicts an example solids control system 100, in accordance with some embodiments. The solids control system 100 generally comprises a weir assembly 102 disposed in a section of a wellbore, for example, in a portion of a casing 104 within the wellbore. In the illustrated embodiment, the weir assembly 102 is depicted as comprising a plurality of insert sections 106, 107, 108, 109, 110, 111, 112 and a plurality of weirs 114, 115 (insert sections 109, 110 are shown as transparent so that weirs 114, 115 are visible). While the illustrated 211 embodiment depicts the plurality of insert sections 106-112 coupled in series to form a single insert, other embodiments may include any number of insert sections disposed within casing 104 in a variety of ways. For example, in at least one embodiment, an insert comprising a single insert section is inserted into the casing 104. In another embodiment, at least a first and a second insert are inserted into the casing 104 but the first insert is not directly coupled to the second insert. In yet another embodiment, the insert sections form more than one insert.

Further, while the illustrated embodiment depicts a single weir 114, 115 per insert section 109, 110, in other embodiments, one or more of the plurality of insert sections 106, 107, 108, 109, 110, 111, 112 may not contain any weirs 114, 115. In at least one embodiment, a single insert section contains more than one weir. The weir assembly 102 is inserted into the casing 104 of the wellbore to reduce the flow of solids through the casing 104 by capturing some of the solids using the weirs 114, 115. Thus, increasing the capacity of the section of the casing 104 to contain contaminate slurry, and avoiding bridging, plugging, and pack-off during well completion operations. The plurality of weirs 114, 115 are oriented within the plurality of insert sections 106-112, and the weir assembly 102 as a whole, so as to selectively increase the velocity of fluid traveling through the weir assembly 102, such that a solids slip velocity separates solids from fluid within the desired section of the wellbore. For example, in at least one embodiment, the weirs 114, 115 are oriented such that a flow opening of the first weir 114 causes solids to deposit at the second weir 115 (if flow direction is from the first weir 114 to the second weir 115) without obstructing a flow opening of the second weir 115. During or following well completion, fluids may be circulated in the section of the casing 104 to remove captured solids from the weir assembly 102.

Figure 2:
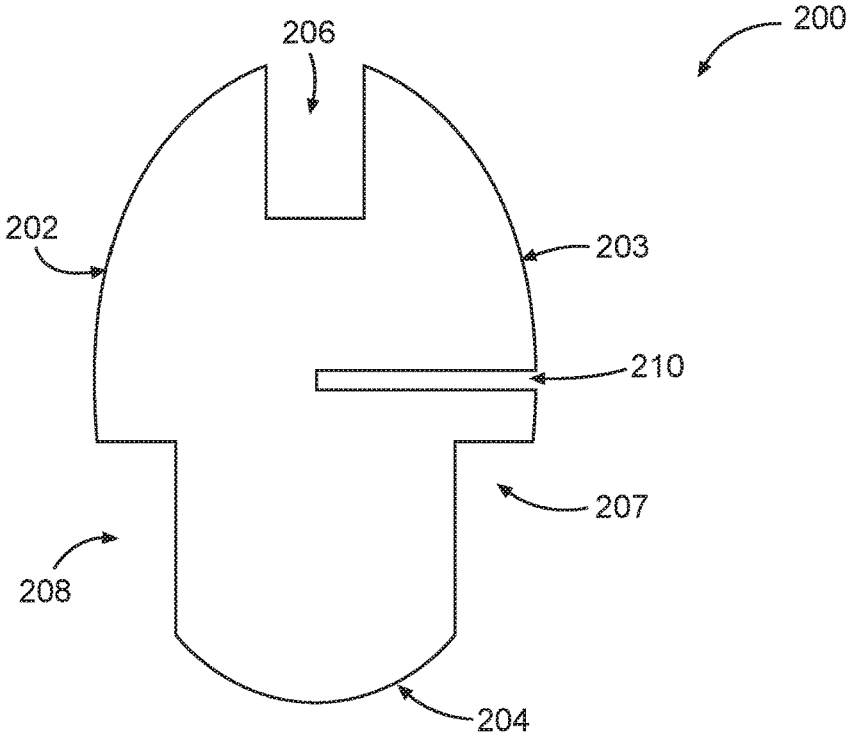
FIG. 2 depicts an example weir plate, in accordance with some embodiments.

FIG. 2 depicts a front view of an example weir plate 200, in accordance with some embodiments. The weir plate 200 may comprise plastic, metal, a combination thereof, or the like. In at least one embodiment, the weir plate 200 comprises a semipermeable material, such as a mesh material. The weir plate 200 is dimensioned so as to fit within a weir assembly (such as weir assembly 102 of FIG. 1). In the illustrated embodiment, the weir plate 200 comprises edges 202, 203, 204 dimensioned to come in contact with one or more interior surfaces of the weir assembly 102. For example, in the illustrated embodiment, the edges 202, 203, 204 are curved so as to fit within and abut the curved interior surface of the weir assembly 102 such that fluid cannot easily pass between the interior surface of the weir assembly 102 and the edges 202, 203, 204 of the weir plate 200.

The weir plate 200 further comprises one or more flow openings 206, 207, 208 such that fluid can flow through the flow openings 206, 207, 208 of the weir plate 200 within the section of the wellbore. While the weir plate 200 is depicted as comprising three flow openings 206, 207, 208, other embodiments may comprise more or less flow openings. Further, the shape, location and orientation of the flow openings 206, 207, 208 may differ for different weir plates as necessary to create a desired tortuous fluid flow path within the section of the wellbore. In the illustrated embodiment, weir plate 200 comprises a slot 210 for receipt of a second weir plate to form a weir as described in greater detail with reference to FIG. 3.

Figure 3:
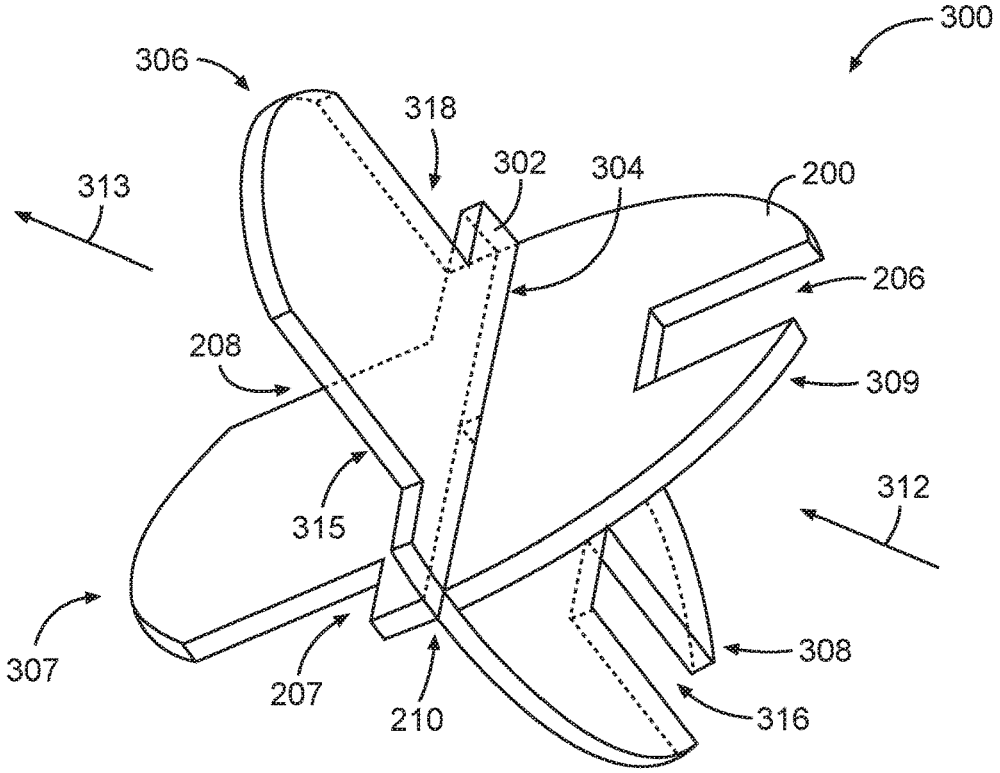
FIG. 3 depicts an example weir, in accordance with some embodiments.

FIG. 3 depicts an example weir 300, in accordance with some embodiments. The weir 300 comprises the first weir plate 200 of FIG. 2, coupled to a second weir plate 302 via the slot 210 of the first weir plate 200 and a slot 304 of the second weir plate 302. While the illustrated embodiment depicts the weir 300 as comprising two weir plates 200, 302, in other embodiments the weir 300 may comprise more or less weir plates 200, 302. Further, while the illustrated embodiment depicts the first weir plate 200 and the second weir plate 302 coupled via corresponding slots 210, 304, in other embodiments the weir plates may be coupled in any of a variety of ways. In at least one embodiment, the weir 300 comprises a plurality of wings 306, 307, 308, 309, such that a major portion of a first wing 306 of the plurality of wings 306, 307, 308, 309 is nonparallel to a major portion of a second wing 307 of the plurality of wings 306, 307, 308, 309. In at least one embodiment, the weir 300 comprises a single unit having a plurality of wings 306, 307, 308, 309 rather than coupled weir plates 200, 302.

In at least one embodiment, the wings 306, 307, 308, 309 of the weir 300 are oriented so as to create a tortuous fluid flow path to increase the separation of solids from fluid within the desired section of the wellbore. For example, in the illustrated embodiment, the first weir plate 200 is oriented relative to the second weir plate 302, such that if fluid flows in the direction indicated by arrows 312, 313, the fluid would be forced through flow openings 206, 316 and then flow openings 207, 208, 315, 318, depositing solids at the portion of the first weir plate 200 between flow opening 207 and flow opening 208, and the portion of the second weir plate 302 between flow opening 315 and flow opening 318. That is, the flow opening 206 of wing 309 causes solids to deposit at wing 306 without obstructing one or more of the flow openings 315, 318 of wing 306, and the flow opening 316 of wing 308 causes solids to deposit at wing 307 without obstructing one or more of the flow openings 207, 208 of wing 307. While the illustrated embodiment depicts the weir 300 as comprising two weir plates 200, 302 of the same design, in other embodiments, the weir 300 may comprise weir plates of different designs. For example, the second weir plate 302 may comprise more or less flow openings 316, 315, 318 than the first weir plate 200, and the flow openings 316, 315, 318 may be of any size and shape as necessary to create the desired tortuous fluid flow path.

Figure 4:
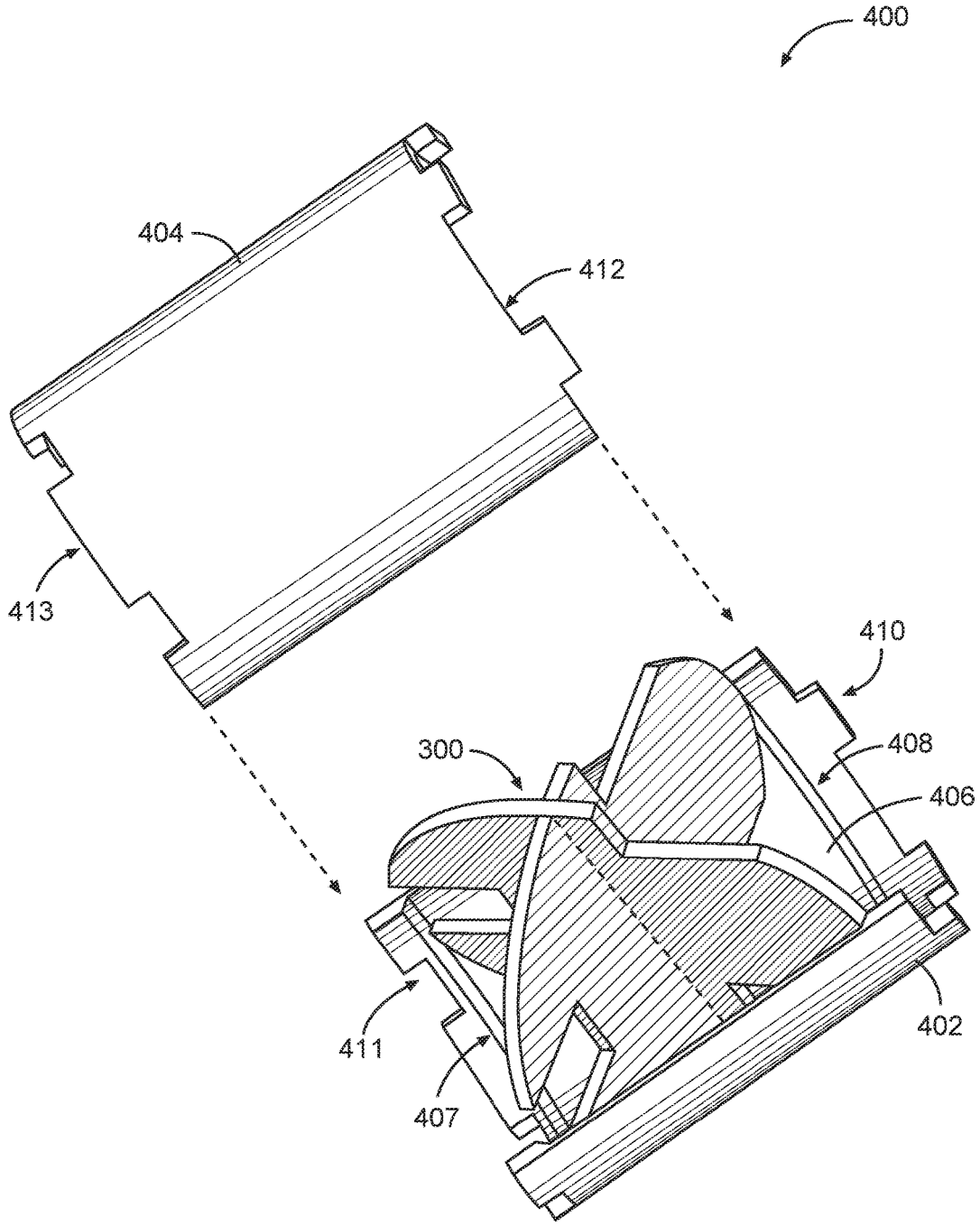
FIG. 4 depicts an example weir assembly, in accordance with some embodiments.

FIG. 4 depicts an example weir assembly 400, in accordance with some embodiments. The weir assembly 400 generally comprises a weir, for example, the weir 300 of FIG. 3, a first portion of an insert 402 and a second portion of an insert 404. The weir 300 is inserted into a slot 406 of the first portion of the insert 402. While the illustrated embodiment depicts the slot 406 as ridges 407, 408, other embodiments may use any of a variety features to form the slot 406 which maintains the location and orientation of the weir 300 in the first portion of the insert 402. In at least one embodiment, the second portion of the insert 404 also comprises a slot to maintain the location and orientation of the weir 300 within the second portion of the insert 404.

The second portion of the insert 404 is coupled to the first portion of the insert 402 using any of a variety of fasteners, for example one or more of, adhesive, screws, bolts, hinges, solder, a weld, clips, a combination of these, or the like. In the illustrated embodiment, each of the first and second portions of the insert, 402, 404 comprise coupling edges 410, 411, 412, 413 to facilitate coupling of the weir assembly 400 to another weir assembly or other apparatus. The weir assembly 400 is generally dimensioned so as to fit within the casing of a wellbore, such that fluids flowing through the relevant section of the wellbore flow through the weir assembly 400.

Figure 5:
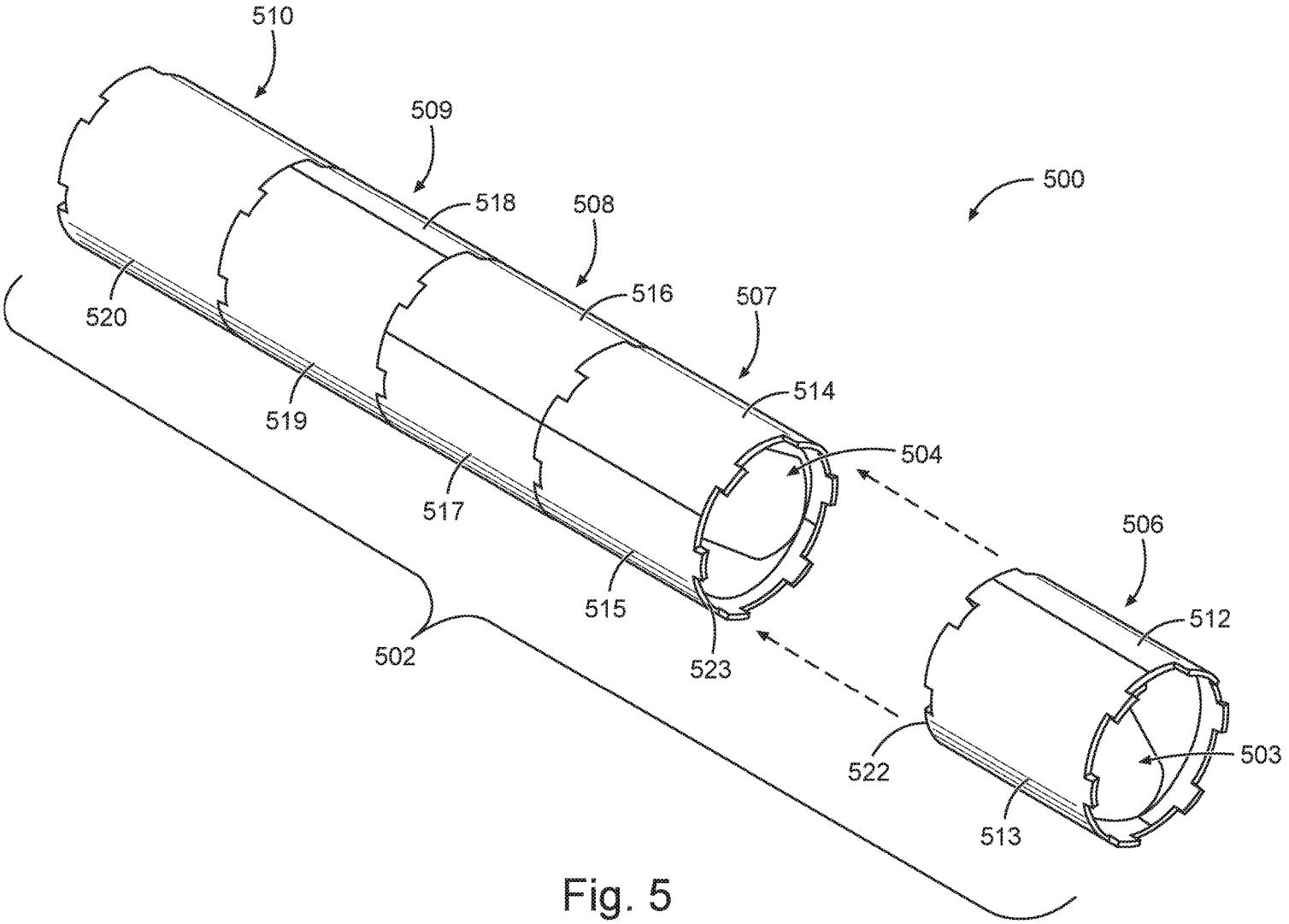
FIG. 5 depicts an example weir assembly comprising a plurality of weirs, in accordance with some embodiments.

FIG. 5 depicts another example weir assembly 500 comprising an insert 502 and a plurality of weirs 503, 504 in accordance with some embodiments. In the illustrated embodiment, the insert 502 comprises a plurality of insert sections 506, 507, 508, 509, 510. Further, each of the plurality of insert sections 506, 507, 508, 509, 510 comprises a first portion 512, 514, 516, 518, 520 and a second portion 513, 515, 517, 519 (only one portion of weir 520 is visible in the depicted view). In at least one embodiment, the plurality of weirs 503, 504 are inserted into the first portions 512, 514, 516, 518, 520, then the second portions 513, 515, 517, 519 are coupled to the first portions 512, 514, 516, 518, 520 to create the individual insert sections 506, 507, 508, 509, 510, enclosing the weirs 503, 504. In other embodiments, one or more of the plurality of insert sections 506, 507, 508, 509, 510 comprises a single portion, such that the weirs 503, 504 are inserted directly into the insert sections 506, 507, 508, 509, 510, or the completed insert 502. While only two weirs 503, 504 are visible in the depicted view of the illustrated embodiment, in different embodiments the insert 502 may comprise more or less weirs 503, 504. For example, in at least one embodiment, each of the insert sections 506, 507, 508, 509, 510 comprises a weir.

In the illustrated embodiment, the insert sections 506, 507, 508, 509, 510 are coupled in series to form the insert 502, and the completed weir assembly 500. In at least one embodiment, the insert sections 506, 507, 508, 509, 510 are coupled in series to form the insert 502 before the weirs 503, 504 are disposed within the insert 502. In the illustrated embodiment, insert section 506 comprises coupling edge 522 to correspond to coupling edge 523 of insert section 507, such that insert section 506 can be coupled to insert section 507. In other embodiments, the insert sections 506, 507, 508, 509, 510 may be coupled in any of a variety of arrangements using any of a variety of coupling techniques. Further, other embodiments may comprise more or less insert sections 506, 507, 508, 509, 510 than the illustrated embodiment. In at least one embodiment, the insert 502 comprises a single insert section.

The insert 502 is dimensioned to be inserted into a section of a wellbore (i.e., the casing) for example, a portion of a shoe track of the casing. For example, in at least one embodiment, the insert 502 is disposed at a lesser depth that is less than a deeper depth at which a guide shoe (or float shoe) of the shoe track is located in the wellbore. The weirs 503, 504 are spaced within the insert 502 so as to increase the separation of solids from fluid within the section of the wellbore when the fluid is flowing through the wellbore.

Figure 6:
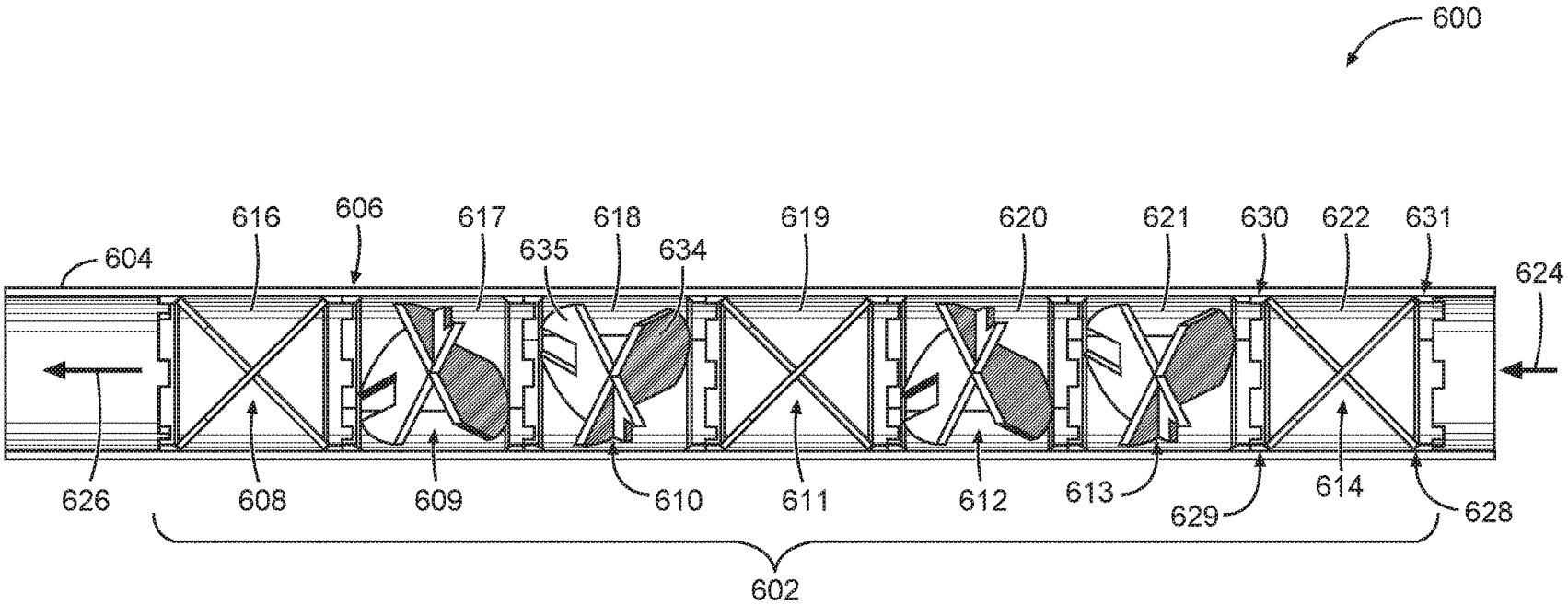
FIG. 6 depicts a cross-section view of an example solids control system, in accordance with some embodiments.

FIG. 6 depicts a cross-section view of an example solids control system 600, in accordance with some embodiments. The solids control system 600 comprises a weir assembly 602 dimensioned to fit within a section of wellbore 604 (for example, a section of casing within a wellbore or a portion of a shoe track within casing of a wellbore). The weir assembly 602 comprises an insert 606 and a plurality of weirs 608, 609, 610, 611, 612, 613, 614. In the illustrated embodiment, the insert 606 comprises a plurality of insert sections 616, 617, 618, 619, 620, 621, 622 coupled in series such that fluid flowing (represented by arrows 624, 626) within the section of the wellbore 604 flows within the insert 606. In other embodiments, the insert 606 may comprises a single seamless unit rather than separate sections coupled together. Further, in the illustrated embodiment, each of the plurality of insert sections 616, 617, 618, 619, 620, 621, 622 comprises one of weirs 608, 609, 610, 611, 612, 613, 614. In other embodiments, one or more insert sections 616, 617, 618, 619, 620, 621, 622 may comprise more than one weir or no weirs at all. The weirs 608, 609, 610, 611, 612, 613, 614 are fitted into slots of the insert 606, which may be formed, for example, using ridges 628, 629, 630, 631. In other embodiments, the orientation and separation of the weirs 608, 609, 610, 611, 612, 613, 614 may be maintained using other techniques or other types of slots.

In the illustrated embodiment, the weirs 608, 609, 610, 611, 612, 613, 614 maintain a different orientation than their neighboring weirs. For example weir 610 is oriented differently than weir 609 or 611. The weirs 608, 609, 610, 611, 612, 613, 614 are spaced and oriented within the section of the wellbore 604 to increase the fluid velocity within the section of the wellbore 604 such that slip velocity of the solids causes them to accumulate away from flow openings of the weirs 608, 609, 610, 611, 612, 613, 614, so as to minimize the flow or movement of solids through the section of the wellbore 604 while avoiding bridging, plugging, and pack-off. For example, in the illustrated embodiment, if the fluid flows in the direction indicated by arrows 624, 626, weir 614 is oriented so as to cause solids to deposit at one of weirs 608, 609, 610, 611, 612, 613, and weir 613 is oriented so as to cause solids to deposit at one of weirs 608, 609, 610, 611, 612, and so on. In some embodiments, the weirs 608, 609, 610, 611, 612, 613, 614 are designed such that flow openings of a first wing 634 of the weir 610 cause solids to deposit on a second wing 635 of the same weir 610. The weirs 608, 609, 610, 611, 612, 613, 614 may comprise any number of weir plates or wings to create a tortuous fluid flow path within the section of the wellbore 604.

Figure 7:
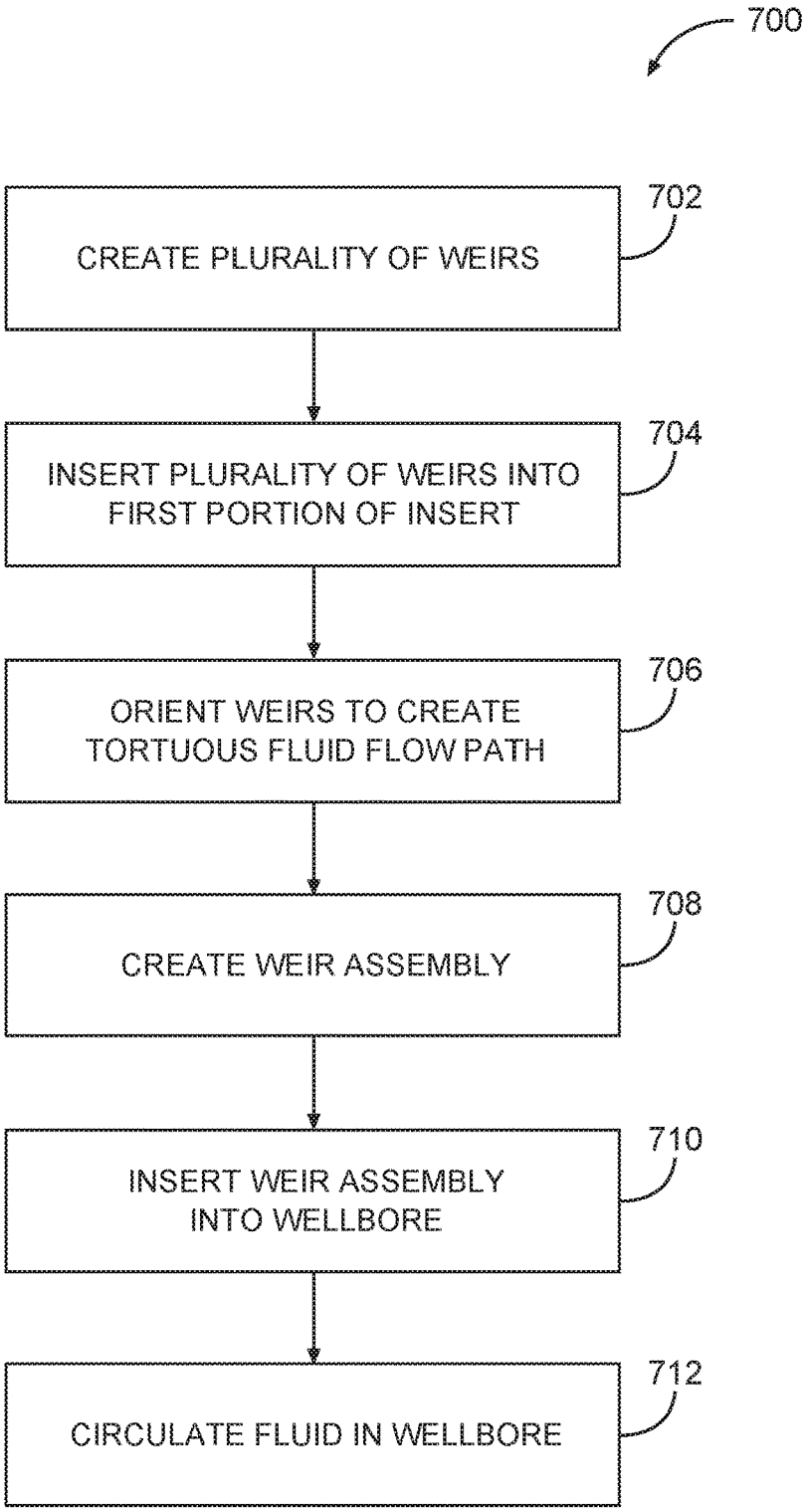
FIG. 7 is a flow diagram of an example method of solids control, in accordance with some embodiments.

FIG. 7 shows features of an example method of solids control 700, in accordance with some embodiments. For purposes of illustration, the method of solids control 700 is described with reference to FIGS. 1-6. At block 702, a plurality of weirs 608, 609, 610, 611, 612, 613, 614 are created. In some embodiments, at least one of the weirs 608, 609, 610, 611, 612, 613, 614 is created as two or more weir plates 200, 302 coupled together. Each weir plate 200, 302 may comprise, for example, one or more flow openings 206, 207, 208 and one or more edges 202, 203, 204. The weir plates 200, 302, may be coupled together using, for example, one or more slots 210, 304. The weir plate may be composed of any of a variety of materials, for example, plastic, metal, semipermeable material, a combination of these, or the like.

At block 704, the plurality of weirs 608, 609, 610, 611, 612, 613, 614 are inserted into a first portion of an insert 402. The first portion of the insert 402 may comprise one or more slots 406 to maintain separation and orientation of the weirs 608, 609, 610, 611, 612, 613, 614. Each slot 406 may be formed, for example, by ridges 407, 408, grooves, or other structural features. In at least one embodiment, the separation and orientation of the weirs 608, 609, 610, 611, 612, 613, 614 is maintained by a friction fit within the insert.

At block 706, the weirs 608, 609, 610, 611, 612, 613, 614 are oriented so as to create a tortuous fluid flow path within a section of a wellbore once inserted into the wellbore. For example, in at least one embodiment, the weirs 608, 609, 610, 611, 612, 613, 614 are spaced and oriented such that when fluid flows through the weirs 608, 609, 610, 611, 612, 613, 614, a flow opening of a first weir 613 causes solids suspended in the fluid to deposit at a second weir 612, or a flow opening of a first wing of a weir causes solids to deposit at a second wing of the weir. The orientation and separation of the weirs 608, 609, 610, 611, 612, 613, 614 allows the flow openings to affect the velocity of the fluid such that a slip velocity of the solids causes the solids to be separated from the fluid and deposited without obstructing flow openings of the weirs 608, 609, 610, 611, 612, 613, 614.

At block 708, the weir assembly 102, 400, 500, 602 is created. For example, in at least one embodiment, a second portion of the insert 404 is coupled to the first portion of the insert 402 to enclose the weir 300 (or a plurality of weirs 608, 609, 610, 611, 612, 613, 614). In some embodiments, a plurality of insert sections 506, 507, 508, 509, 510 are coupled to create the weir assembly 500. In at least one embodiment, the insert 502 is formed before the weirs 608, 609, 610, 611, 612, 613, 614 are disposed at the interior of the insert 502. In some embodiments, the insert 502 comprises a single section. The insert 502, and the weir assembly 500 as a whole, is dimensioned to fit within a section of the wellbore, for example within a section of the casing within the wellbore.

At block 710, the weir assembly 102, 602 is inserted into the wellbore, until the weir assembly 102, 602 is positioned so as to affect the desired section of the wellbore 104, 604. In some embodiments, the section of the wellbore 104, 604 comprises a section of the casing of the wellbore. In at least one embodiment, the section of the wellbore 104, 604 comprises a portion of a shoe track in the wellbore. For example, in at least one embodiment, the weir assembly 102, 602 is disposed at a lesser depth that is less than a deeper depth at which a guide shoe is located in the shoe track of the wellbore. In at least one embodiment, the weir assembly 102, 602 is positioned in an open-hole section of a horizontal wellbore where autofill floating equipment is used. In such an embodiment, as the tubular casing is run into the wellbore and fluids enter the inner diameter of the casing through the activity of the autofill equipment, solids carried by the fluid enter the weir assembly 102, 602. The weir assembly 102, 602 creates a tortuous fluid flow path, such that the solids are deposited within the weir assembly 102, 602, while the fluids (that have been separated from the deposited solids) continue through the casing of the wellbore. The solids are deposited at one or more of the weirs 608, 609, 610, 611, 612, 613, 614 without causing, or at least reducing incidences of bridging, plugging, and pack-off.

At block 712, fluid is circulated through the section of the wellbore 104, 604 to clean the weir assembly 102, 602, in at least one embodiment, the weir assembly 102, 602 is designed to be self-cleaning with fluid circulation once casing running operations are complete. In at least one embodiment, the weir assembly 102, 602 maximizes the capacity of the section of the wellbore 104, 604 to contain contaminate slurry during cementing operations by removing at least a portion of the deposited solids. In at least one embodiment the weir assembly 102, 602 can be rotated within the wellbore to change the location of the solids as a result of gravity.

Figure 8:
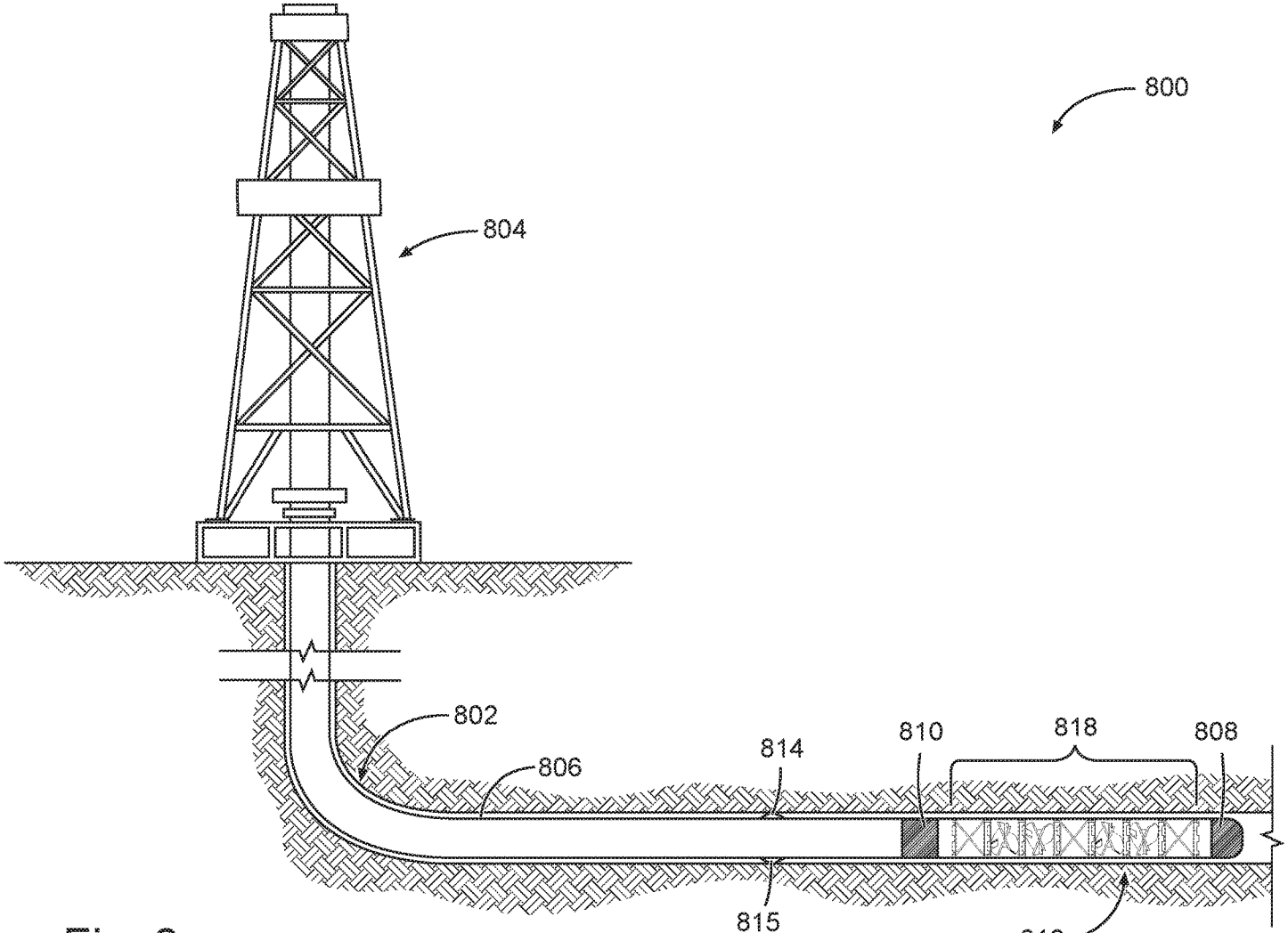
FIG. 8 depicts an example solids control system in use during a well completion operation, in accordance with some embodiments.

FIG. 8 depicts an example solids control system 800 in use during a well completion operation, in accordance with some embodiments. Well completion occurs after the wellbore 802 has been drilled, but before the well 804 can produce. Well completion can include casing, cementing, perforating, gravel packing, production tree installation, or other operations.

Casing operations help ensure that the wellbore 802 will not collapse when drilling fluids are removed from the wellbore 802 and protect the drilling fluids from contamination by other materials of the wellbore 802. The casing operations generally comprise joining sections of tube (or joints), for example steel or other metal, to form a casing 806. The casing 806 is then run into the wellbore 802. Different diameters of casing 806 may be used at different locations within the wellbore 802. For example, a casing program may include production casing, intermediate casing, surface casing, conductor casing, or the like, each comprising a different diameter tube for the casing 806. An accurate casing program is essential to ensuring that the well can flow properly given the wellbore conditions.

A guide shoe 808 guides the first joint of the casing 806 into the wellbore 802. The space between the guide shoe 808 and a float collar 810 (e.g., an auto-fill float collar) define a shoe track 812. The purpose of the shoe track 812 is to avoid over-displacing cement during cementing operations. The float collar 810 (e.g., an auto-fill float collar) and the guide shoe 808 prevent reverse flow of cement back into the casing after placement. The shoe track 812 may comprise a single section of the casing 806 or multiple joints of the casing 806. In some applications, one or more centralizers 814, 815 keep the casing 806 off the wall of the wellbore 802 to ensure proper cementing operations. Some applications may further utilize scratchers to remove wall cake and ensure that the cement bonds to the wall of the wellbore 802. In at least one embodiment, the solids control system 800 comprises an open-hole completion.

A weir assembly 818 (which may comprise one or more of the features described with reference to FIGS. 1-7) is inserted into a section of the casing 806 before the section of the casing 806 is run into the wellbore 802. For example, in at least one embodiment, the weir assembly 818 is disposed at the first section of the casing 806 to be run into the wellbore 802. In at least one embodiment, the weir assembly 818 is disposed at the shoe track 812, that is, between the shoe guide 808 and the float collar 810.

The weir assembly 818 creates a tortuous fluid flow path as fluids from the wellbore 802 flow through the casing 806 as it is being run into the wellbore 802. The tortuous fluid flow path is created by flow openings of one or more weirs within an insert of the weir assembly 818. The weirs are spaced and oriented within the insert so as to increase the separation of solids from fluids within a section of the wellbore 802 as the fluid passes through. In the example of a horizontal section of the wellbore 802, gravity causes the solids to deposit on the lower side of the casing 806, and the weirs can be arranged such that one or more weirs catch the solids, while still allowing the fluids to flow through the casing 806 unobstructed. This helps to avoid bridging, plugging or pack-off while casing running operations are performed. In at least one embodiment, the weir assembly 818 is self-cleaning, such that fluids can be circulated through the weir assembly to dislodge some or all of the deposited solids from the weir assembly 818. As a result of the function of the weir assembly 818, the shoe track 812 maintains a greater capacity for containing contaminated slurry during the cementing portion of the completion operations.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A method, comprising:

creating a tortuous fluid flow path in a section of a wellbore to increase the separation of solids from fluid within the section of the wellbore, wherein creating the tortuous fluid flow path comprises inserting a weir assembly into the section of the wellbore, the weir assembly comprising a plurality of weirs, wherein each weir of the plurality of weirs is angularly offset from any adjacent weirs and comprises a first wing and a second wing, and wherein a majority of the first wing is nonparallel to a majority of the second wing.

2. The method of claim 1, wherein the section of the wellbore comprises at least a portion of a casing within the wellbore.

3. The method of claim 2, wherein the section of the wellbore comprises at least a portion of a shoe track of the casing.

4. The method of claim 1, wherein creating the tortuous fluid flow path further comprises:

orienting the plurality of weirs, such that a flow opening of a first weir causes at least some of the solids to deposit at a second weir without obstructing a flow opening of the second weir.

5. The method of claim 1, wherein creating the tortuous fluid flow path comprises:

orienting a plurality of weirs within the section of the wellbore, so as to selectively increase the velocity of the fluid, such that a solids slip velocity separates at least some of the solids from the fluid within the section of the wellbore.

6. A method, comprising:

inserting a plurality of weirs into an insert to create a weir assembly; and inserting the weir assembly into a wellbore to create a tortuous fluid flow path in the wellbore, wherein each weir of the plurality of weirs is angularly offset from any adjacent weirs and comprises a first wing and a second wing, and wherein a majority of the first wing is nonparallel to majority of the second wing.

7. The method of claim 6, wherein the tortuous fluid flow path reduces the flow of solids through the wellbore by capturing some of the solids using the weirs.

8. The method of claim 6, wherein inserting the plurality of weirs into the insert to create the weir assembly comprises:

inserting the plurality of weirs into slots of a first portion of the insert; and coupling a second portion of the insert to the first portion of the insert to create the weir assembly.

9. A system, comprising:

an insert dimensioned to be inserted into a section of a wellbore; and a plurality of weirs spaced within the insert so as to increase the separation of solids from fluid within the section of the wellbore when the fluid is flowing through the wellbore, wherein each weir of the plurality of weirs is angularly offset from any adjacent weirs and comprises a first wing and a second wing, and wherein a majority of the first wing is nonparallel to a majority of the second wing.

10. The system of claim 9, wherein the first wing is oriented relative to the second wing such that a flow opening of the first wing causes at least some of the solids to deposit at the second wing without obstructing a flow opening of the second wing.

11. The system of claim 9, wherein at least one weir of the plurality of weirs comprises:

a first weir plate; and a second weir plate, wherein the first weir plate is coupled to the second weir plate via corresponding slots in the weir plates.

12. The system of claim 9, wherein the insert comprises a plurality of sections, such that at least one section of the insert houses at least one weir of the plurality of weirs.

13. The system of claim 9, wherein the section of the wellbore comprises at least a portion of a casing within the wellbore.

14. The system of claim 9, wherein the system further comprises a guide shoe located within the wellbore and the insert is disposed at a depth that is less than a depth at which a guide shoe is located in the wellbore.

15. The system of claim 9, wherein the insert further comprises:

slots to maintain an orientation and separation of the plurality of weirs within the insert.

16. The system of claim 9, wherein the insert further comprises:

a first portion to receive the plurality of weirs; and a second portion to couple to the first portion to form a weir assembly.

* * * * *